United States Patent [19]

Smith, II

[11] Patent Number: 5,064,493

[45] Date of Patent: Nov. 12, 1991

[54] METHOD OF PRODUCING CURVED HONEYCOMB CORE MATERIAL HAVING CRIMPS IN ONE EDGE

[75] Inventor: James F. Smith, II, Owasso, Okla.

[73] Assignee: Lansing Overhaul and Repair, Inc., Tulsa, Okla.

[21] Appl. No.: 594,293

[22] Filed: Oct. 9, 1990

[51] Int. Cl.[5] ..... B32B 3/12; B31F 1/22; B31F 1/20

[52] U.S. Cl. ..... 156/207; 264/286; 428/118

[58] Field of Search ..... 428/116, 118; 156/197, 156/207, 204, 242, 209; 493/463; 264/286, 287

[56] References Cited

U.S. PATENT DOCUMENTS

| | | | |
|---|---|---|---|
| 1,000,758 | 8/1911 | Rude | 428/116 X |
| 2,041,889 | 5/1936 | Wheeler | 264/286 |
| 2,848,132 | 8/1958 | Davous | 156/197 X |
| 3,503,310 | 3/1970 | Goetz | 264/286 |
| 4,457,963 | 7/1984 | Ittner et al. | 428/116 X |

FOREIGN PATENT DOCUMENTS

| | | | |
|---|---|---|---|
| 0015900 | of 1890 | United Kingdom | 428/116 |
| 1390968 | 4/1975 | United Kingdom | 428/118 |

*Primary Examiner*—Michael W. Ball
*Assistant Examiner*—Adrienne C. Johnstone
*Attorney, Agent, or Firm*—Head & Johnson

[57] ABSTRACT

A curved panel is formed of joined corrugated strips with a series of crimps in one side, of each strip so that the crimped side is shorter than the non-crimped side, resulting in a curved strip which is joined to other such strips in a side-to-side fashion to form a curved core with a honeycomb cells therein, and on which coverings are placed to form a panel.

3 Claims, 2 Drawing Sheets

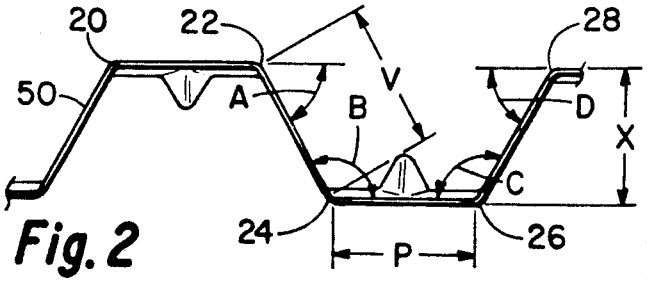
Fig. 2
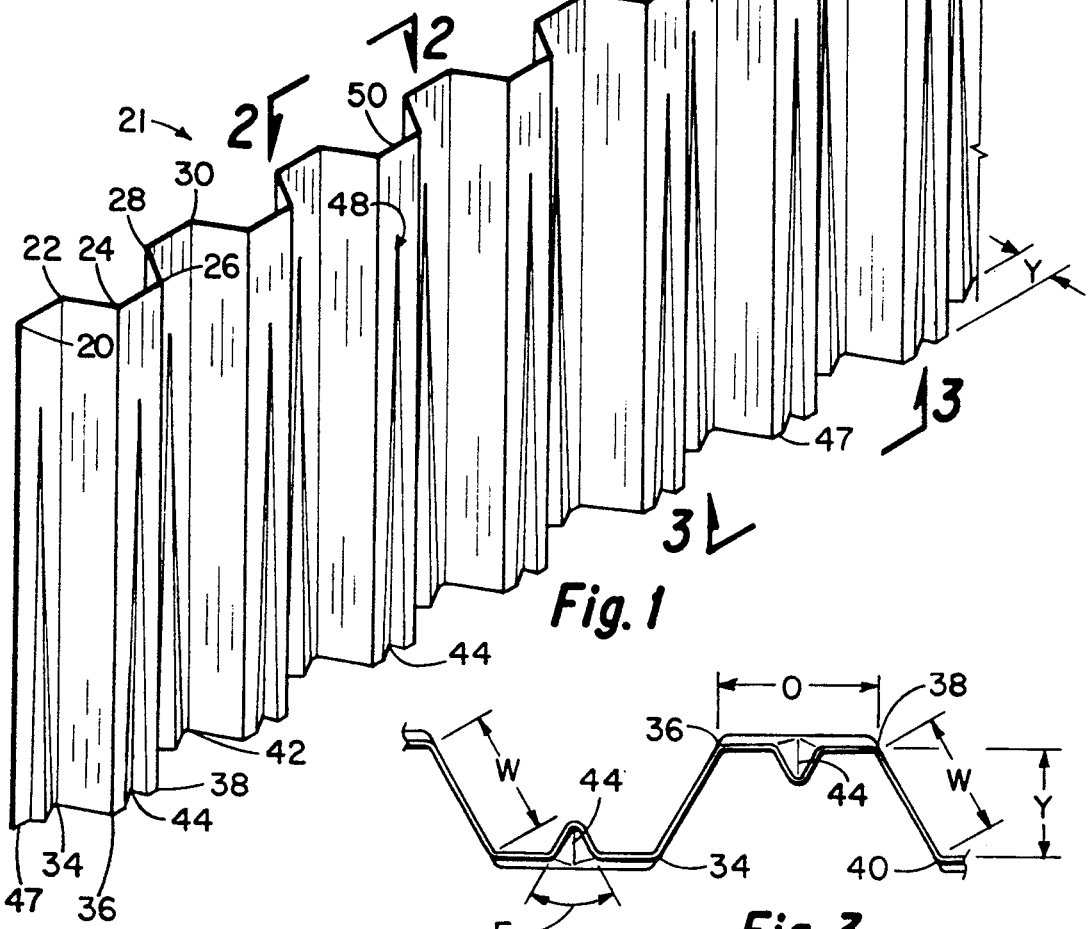
Fig. 1
Fig. 3
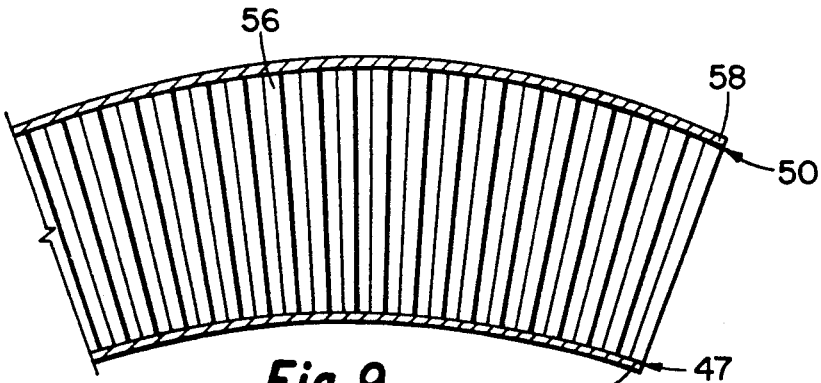
Fig. 9

METHOD OF PRODUCING CURVED HONEYCOMB CORE MATERIAL HAVING CRIMPS IN ONE EDGE

BACKGROUND OF THE INVENTION

1. Field of the Invention

This invention relates to curved structural paneling.

2. Description of the Related Art

Various types of structural paneling is available. Some panels have solid cores, others have cavitated cores. A flat, or smooth, surface covering is usually placed over the core material. Most commercial paneling is flat. Curved paneling is difficult to produce and usually does not provide great strength or stability. In cavitated forms of paneling, a honeycomb configuration of the core wherein hexagonal cells form the core, is known. In the honeycomb configuration, strips of corrugated material are joined forming cells with the width of the strips being the cell height. Generally, it is impossible to form curved panels when the cell height is greater than the cell diameter. That problem is solved with this invention.

SUMMARY OF THE INVENTION

It is the purpose of this invention to produce curved paneling with a honey-comb core, or other corrugated core, such that curvature may be produced when cell height within the core exceeds cell diameter.

Strips or flat sheets of metal, or other suitable material, are formed into a continuous alternating series of half-hexagonal shapes, when viewed in cross-section, which form a continuous "wave pattern" or corrugation. A tapering V-shaped crimp is formed in one edge only of the strip preferably at each half-hexagonal portion and ends before reaching the other edge, thus producing a sequence of crimps in one edge only. This reduces the linear length of the edge with the crimps, as compared with the length of the non-crimped edge. The strips are then joined side-to-side forming a honey-comb like structure for use as the core of a panel. All of the crimped edges are on one side of the core, and all of the non-crimped edges are on the other side of the core. Thus, the crimped side of the core is shorter than the non-crimped side and curvature results. By varying the size and angle of crimp, various radii of curvature may be formed. The curved sides of the core may be covered by any suitable material, such as sheets of metal, plastic or the like, which, when covered, form the completed panel.

BRIEF DESCRIPTION OF THE DRAWINGS

FIG. 1 is an isometric view of a strip for use in manufacturing a curved core for a panel.

FIG. 2 is an end view taken along line 1—1 of FIG. 2 of the uncrimped edge of the formed strip.

FIG. 3 is an end view taken along line 3—3 of FIG. 2 of the crimped edge of the formed strip.

FIG. 9 is a side view of a curved core with coverings on both sides, forming a curved panel.

DETAILED DESCRIPTION OF THE PREFERRED EMBODIMENT

Figure 7:
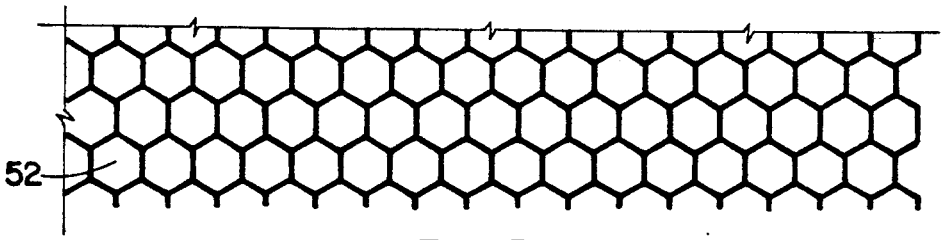
FIG. 7 is a top view taken along line 7—7 of FIG. 4 showing the honey-comb cell pattern of the core formed by the joined non-crimped edges of a plurality of the strips shown in FIG. 1.

A curved panel is formed by joining strips of corrugated material, each strip having a crimped edge and a non-crimped edge, both edges extending along the length of said strip, to form a core which is then covered with a suitable covering to form a panel. FIG. 1 illustrates a strip formed by a continuous series of alternating half-hexagonal shapes, generally indicated by the numeral 21. The strip shown in FIG. 1 is made from a flat sheet of metal using a die. The half-hexagonal shapes may be formed by the dies such that segments denoted by 20–22 and by 28–30 are in the plane of the original flat surface of the strip, or a surface parallel thereto.

At position 22 the strip is bent by the die at about 60 degrees, angle A, forming a segment 22–24 which ends at position 24 and is then bent back at about 120 degrees, angle B, to form segment 24–26 which is parallel to segments 20–22 and 28–30. At position 26 another bend of angle C of about 120 degrees is formed to take segment 26–28 back to the original plane at position 28. Segment 28–30 is bent at angle D at about 60 degrees from the plane of segment 26–28 to form a segment in the same plane as the starting segment of 20–22. This formation of non-crimped half-hexagonal shapes is then repeated until a strip of desired length is formed. The segments, 22–24, 24–26, 26–28, 28–30 are preferably equal in length.

The opposite edge 47 of the strip 21 contains similar bends at 34, 36, and 38 as seen in FIGS. 1 and 3. In addition, alternate segments on the strip opposite edge 47 each have a tapering V-shaped crimp 44 therein as seen in FIGS. 1 and 3. As illustrated in FIG. 1, the crimps 44 are tapered with their greatest depth and width at the edge 47 of the strip 21, and tapering therefrom to a point 48 where the taper ends before reaching the opposite edge 50. The angle of the crimp 44 is preferably approximately 60 degrees, as illustrated by angle E in FIG. 3.

The purpose of the series of crimps 44 is to take up material along the strip edge 47. The segment 24–26 on the non-crimped edge 50 has a length "P" as seen in FIG. 2. The segment 36–38 on the crimped edge 47 has a length of "O" as seen in FIG. 3. The length "O" is greater than "P."

The angled segments of the strip are tapered. The length between points 26–28 of edge 50 is "V" as seen in FIG. 2. The length between points 38–40 of the same segment at edge 47 is "W" as seen in FIG. 3. The spacing between opposed planes of the corrugated strip at the uncrimped edge 50 is "X" as seen in FIG. 2. The corresponding spacing between opposed planes of the corrugated strip at the cramped edge 47 is "Y" as seen in FIG. 3. The length "X" is greater than the length "Y." By joining together a plurality of strips 21 wherein V>W, O>P and X>Y, a curved honeycomb as shown in FIGS. 4–9 is achieved.

Strip 21 may be formed of metal or plastic or other suitable material and may be produced by folding, stamping, molding, pressing or other suitable process. By varying the size and angle of corrugating crimping each strip, various radii of curvature may be produced. The width of the strips determines the thickness of the core.

Hexagonal shapes are used herein for forming a honey-comb pattern. Other polygonal shapes (not shown) can be used. Curved shapes (not shown), as in strips formed with a recurring sine wave may also be used. However, the hexagonal (honey-comb) shape is used in the preferred embodiment.

Figure 4:
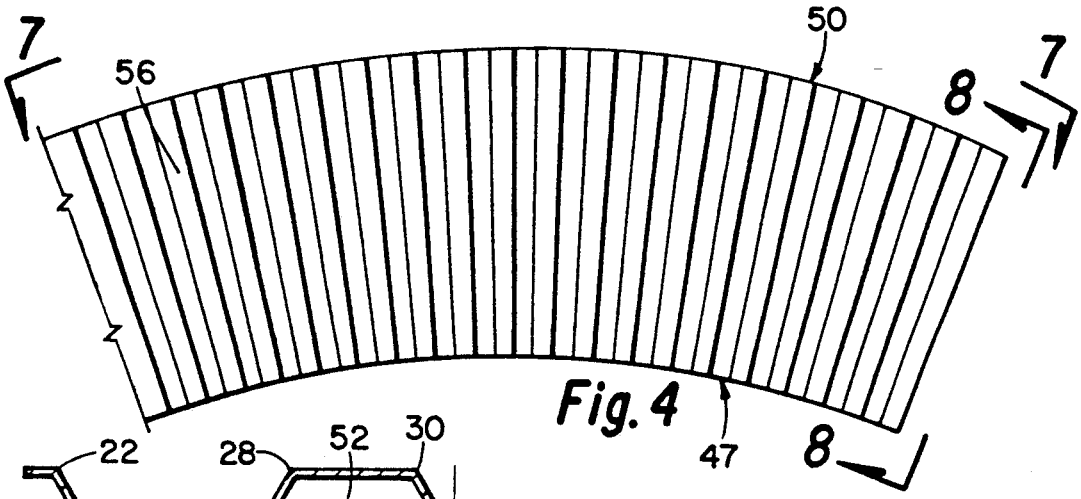
FIG. 4 is a side view of a curved honeycomb core as manufactured using a plurality of strips of the type shown in FIG. 1.
Figure 5:
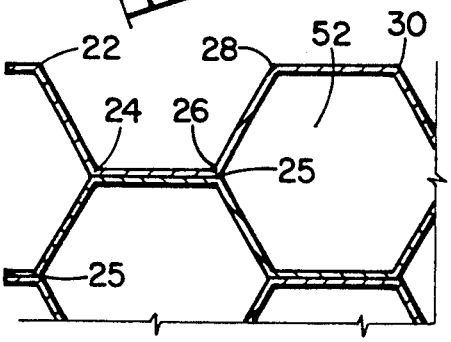
FIG. 5 is an enlarged detailed cross sectional end view taken along line 5—5 of FIG. 8 showing the joined non-crimped edges of the strips forming the honeycomb core.
Figure 8:
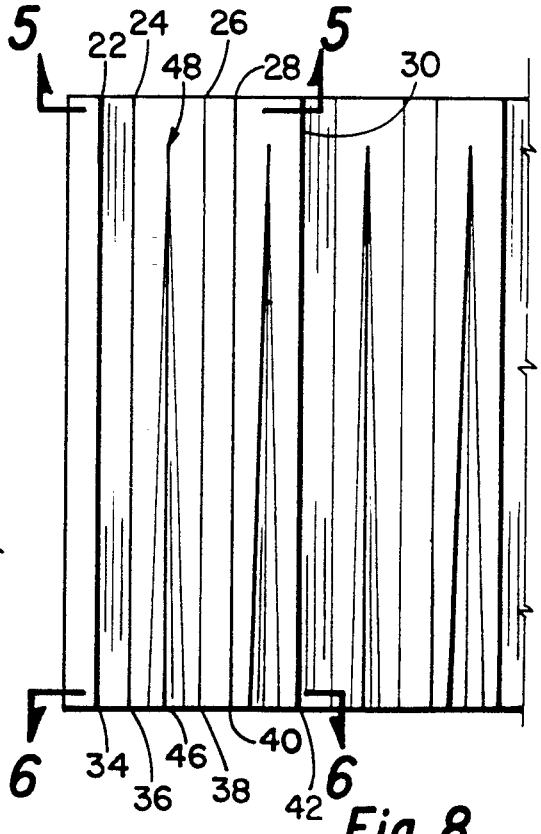
FIG. 8 is an end view taken along line 8—8 FIG. 4 illustrating the tapering crimps in the cell walls.
Figure 6:
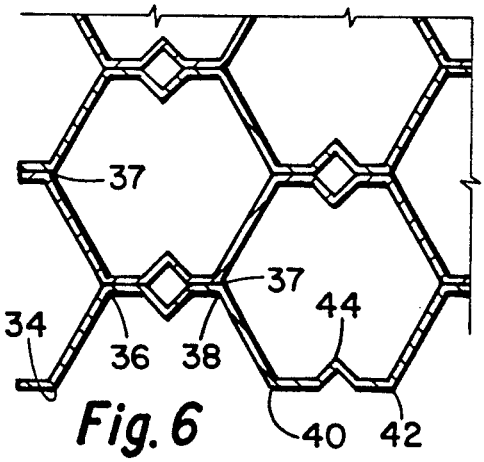
FIG. 6 is an enlarged detailed cross-sectional end view taken along line 6—6 of FIG. 8 showing the joined crimped edges of the strips forming the honeycomb core.

A plurality of strips 21 are joined together in a side-to-side manner to make the curved core 56, as illustrated in FIGS. 4 and 9. In joining strips the edges 50 without crimps are joined to other non-crimped edges 50, and, the edges 47 with crimps, are joined to other crimped edges 47. FIG. 5 shows an end view of the joined non-crimped edges 50 of strips 21 and the area of joining 25 to form a series of honeycomb shaped cells 52. FIG. 6 illustrates an end view of the joined crimped edges 47 of strips 21 and the area of joining 37. FIG. 7 is an end view similar to FIG. 5 in smaller detail showing a part of a core formed of honey-comb cells 52 produced by joining strips 21.

The strips 21 may be joined by any suitable method, such as spot welding, brazing, gluing, bolting, riveting, and the like.

Once the core 56 is formed, a covering 58 may be placed on the longer curved surface 50 and another covering 60 on the shorter curved surface 47. These coverings 58 and 60 may be metal, plastic, FORMICA, or other suitable material, and form the completed curved panel.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A method of forming curved honeycomb core material, comprising the steps of:

shaping a plurality of strips of material into a continuous alternating series of half-hexagonal shapes, each said strip having a first edge and a second edge both extending along the length of said strip;

forming a sequence of tapered crimps in said first edge only of each said strip such as to reduce the linear length of said first edge;

and joining said strips together in a side-to-side manner.

2. The method, as described in claim 1, wherein said joining step comprises fastening the strips together with all first crimped edges on one side, and all non-crimped second edges on the other side, thus forming a plurality of honeycombed cells between said joined strips.

3. The method, as described in claim 1, further comprising the steps of attaching a covering to both sides of said core, thus forming a panel.

* * * * *

UNITED STATES PATENT AND TRADEMARK OFFICE

CERTIFICATE OF CORRECTION

PATENT NO. : 5,064,493

DATED : Nov. 12, 1991

INVENTOR(S) : James F. Smith, II

It is certified that error appears in the above—identified patent and that said Letters Patent is hereby corrected as shown below:

On the Title page, Abstract, item [57], line 6, change "cells" to --cell-.

Col. 1, line 27, change "honey-comb" to --honeycomb--;

Col. 1, line 41, change "honey-comb" to --honeycomb--.

Col. 2, line 4, change "honey-comb" to --honeycomb--.

Col. 3, line 11, change "honey-comb" to --honeycomb--;

Col. 3, line 14, change "honey-comb" to --honeycomb--;

Col. 3, line 27, change "honey-comb" to --honeycomb--.

Col, 2, line 66, change "cramped" to --crimped--.

Signed and Sealed this

Twenty-fifth Day of May, 1993

*Attest:*

Michael K. Kirk

MICHAEL K. KIRK

*Attesting Officer*

*Acting Commissioner of Patents and Trademarks*